US010093462B2

(12) United States Patent
McArthur

(10) Patent No.: US 10,093,462 B2
(45) Date of Patent: Oct. 9, 2018

(54) BEVERAGE CUP LID FOR SUSPENDING A CAN IN THE CUP INTERIOR

(71) Applicant: Jerry C. McArthur, North Vancouver (CA)

(72) Inventor: Jerry C. McArthur, North Vancouver (CA)

( * ) Notice: Subject to any disclaimer, the term of this patent is extended or adjusted under 35 U.S.C. 154(b) by 73 days.

(21) Appl. No.: 15/077,301

(22) Filed: Mar. 22, 2016

(65) Prior Publication Data

US 2017/0273483 A1 Sep. 28, 2017

(51) Int. Cl.

| | |
|---|---|
| ***B65D 51/28*** | (2006.01) |
| ***B65D 77/04*** | (2006.01) |
| ***B65D 81/38*** | (2006.01) |
| ***B65D 43/02*** | (2006.01) |
| ***A47G 23/02*** | (2006.01) |
| *B65D 17/28* | (2006.01) |

(52) U.S. Cl.

CPC ..... *B65D 51/28* (2013.01); *A47G 23/0266* (2013.01); *B65D 43/0212* (2013.01); *B65D 77/0493* (2013.01); *B65D 81/3876* (2013.01); *A47G 2023/0275* (2013.01); *B65D 17/4012* (2018.01); *B65D 2517/0049* (2013.01); *B65D 2543/00046* (2013.01); *B65D 2543/00092* (2013.01); *B65D 2543/00231* (2013.01); *B65D 2543/00296* (2013.01); *B65D 2543/00509* (2013.01); *B65D 2543/00537* (2013.01); *B65D 2543/00555* (2013.01); *B65D 2543/00629* (2013.01); *B65D 2543/00685* (2013.01); *B65D 2543/00731* (2013.01); *B65D 2543/00796* (2013.01); *B65D 2543/00972* (2013.01)

(58) Field of Classification Search

CPC ..... A47G 23/0266; A47G 19/2272; A47G 19/2205; A47G 19/2288; B65D 2517/0041; B65D 51/28; B65D 81/3865; B65D 81/3837; B65D 81/3876

USPC ..... 220/740

See application file for complete search history.

(56) References Cited

U.S. PATENT DOCUMENTS 2,839,229 A * 6/1958 Scheswohl ..... B65D 47/122 215/307

3,850,341 A * 11/1974 Bart ..... B65D 41/18 215/228

(Continued)

*Primary Examiner* — Jeffrey Allen

*Assistant Examiner* — Jennifer Castroitta

(74) *Attorney, Agent, or Firm* — Bruce M. Green; Oyen Wiggs Green & Mutala LLP

(57) ABSTRACT

A lid for a disposable coffee cup is provided which permits a user to drink from a beverage can, such as a beer or pop can, suspended within the interior of the disposable coffee cup. The lid has an outer rim which engages with the rim of the disposable cup. It also has an inner circular attachment ring attached to the inner surface of the lid which has tabs to grasp the rim of the beverage can and form an upper chamber through which the beverage can flow from the beverage can opening to the lid's drinking aperture. The beverage flows from the beverage can through the lid aperture when the cup is tipped. The user can thereby drink from the beverage can without the user's lips touching the can surface. Also it appears to an observer that the user is drinking from the disposable cup, not the beverage can, and also the beverage can is insulated to keep it cold.

12 Claims, 12 Drawing Sheets

(56) References Cited

U.S. PATENT DOCUMENTS 4,790,444 A * 12/1988 Terzi ..... B65D 25/48 220/714
4,883,192 A * 11/1989 Krugman ..... B65D 25/48 220/711
4,938,379 A * 7/1990 Kellner ..... B65D 25/48 220/370
4,961,510 A 10/1990 Dvoracek
5,071,042 A * 12/1991 Esposito ..... B65D 25/48 220/711
5,110,002 A * 5/1992 Tucker ..... B65D 43/0212 220/254.3
5,125,525 A * 6/1992 Tucker ..... B65D 43/0212 206/151
5,947,324 A * 9/1999 Palinchak ..... B65D 25/48 220/711
6,155,452 A * 12/2000 Laurent ..... B65D 81/3876 220/711
6,206,223 B1 3/2001 Wicker
6,367,652 B1 4/2002 Toida et al.
RE42,421 E 6/2011 Toida et al.
8,381,935 B1 2/2013 Buck
8,511,507 B1 8/2013 Malik
8,695,845 B2 4/2014 Buck
2004/0000551 A1* 1/2004 Flink ..... B65D 47/06 220/258.3
2004/0084452 A1 5/2004 Hsieh
2004/0118847 A1 6/2004 Giraud
2006/0237471 A1* 10/2006 Aafjes ..... B65D 25/48 220/780
2011/0127267 A1 6/2011 Leach
2015/0014322 A1 1/2015 Kim
2015/0122828 A1 5/2015 Madala
2015/0191293 A1 7/2015 Forcella
2016/0159531 A1* 6/2016 Li ..... B65D 47/068 220/713

* cited by examiner

BEVERAGE CUP LID FOR SUSPENDING A CAN IN THE CUP INTERIOR

TECHNICAL FIELD

The invention relates to the field of beverage containers and dispensers and more particularly to a lid for use in combination with a drinking cup which enables drinking from a container suspended within the cup.

BACKGROUND

Standard existing disposable beverage cup lids engage and seal the rim of the disposable cup to prevent spilling the beverage while having a small opening through which the user can drink the beverage. For example existing lids for disposable coffee cups enable a user to drink from the cup through an opening in the lid comfortably and allow the cup to be transported without spilling. The lid typically has an opening near the periphery through which the beverage is drunk, and is recessed adjacent the opening to accommodate the upper lip of the person drinking from the cup.

A popular form of beverage container currently is the aluminum can, which is used to contain and dispense beverages such as soda pop, beer or juices. One advantage of aluminum cans is that they are readily chilled. Once chilled, it is desirable to retain the cold temperature of the beverage can. One way to achieve this has been the use of an insulating sleeve sometimes referred to as a "koozie". This is typically a cylindrical insulated foam sleeve into which the can fits snuggly, to thermally insulate the can from external heat, whether conducted heat from the user's hand or surrounding ambient air or radiant heat from sunlight. The koozie encloses the side walls and the base of the can, leaving the top end of the can open to allow the beverage to be consumed or poured.

In some cases the cans are stored in public and possibly unsanitary conditions, so a user may be reluctant to place his/her lips on the mouth or rim of the beverage can for hygienic reasons, such as where the user may be unaware of how the can has been stored in public places or facilities. There is a need therefore for a hygienic holder for drinking from a beverage can. In some situations it may be desirable for the user's hands not to be in contact with the chilled or heated can for purposes of comfort and to maintain the beverage can in a chilled or heated state. The user may also want to disguise the fact that the user is drinking from a beverage can, for example a beer or pop can in a situation where beer or pop consumption would not be appropriate. There is a therefore a need to provide a device to permit a user to drink from a beverage can which is suspended within a disposable cup for insulation, hygienic purposes and so that it appears to an observer that the user is drinking the canned beverage from a disposable paper cup such as a coffee cup.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with products, devices and apparatus which are meant to be exemplary and illustrative, not limiting in scope. In various embodiments, one or more of the above-described problems have been reduced or eliminated, while other embodiments are directed to other improvements.

One aspect of the invention provides a device which permits a user to drink from a beverage can suspended within the interior of a disposable coffee cup, so it appears the user is drinking coffee, and also the beverage can is insulated to keep it cold or hot. According to one embodiment, the lid has a standard outer circumference which engages and seals with the rim of the cup. It also has an inner circular ring attached to the lower inner surface of the lid which has tabs to grasp the rim of the beverage can and form an upper chamber through which the beverage can flow from the beverage can opening to the lid's drinking aperture. A gasket seals the circumference of the circular ring against the beverage can. Thus the beverage can is suspended in the interior of the coffee cup and the beverage flows from the beverage can through the lid aperture when the cup is tipped.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
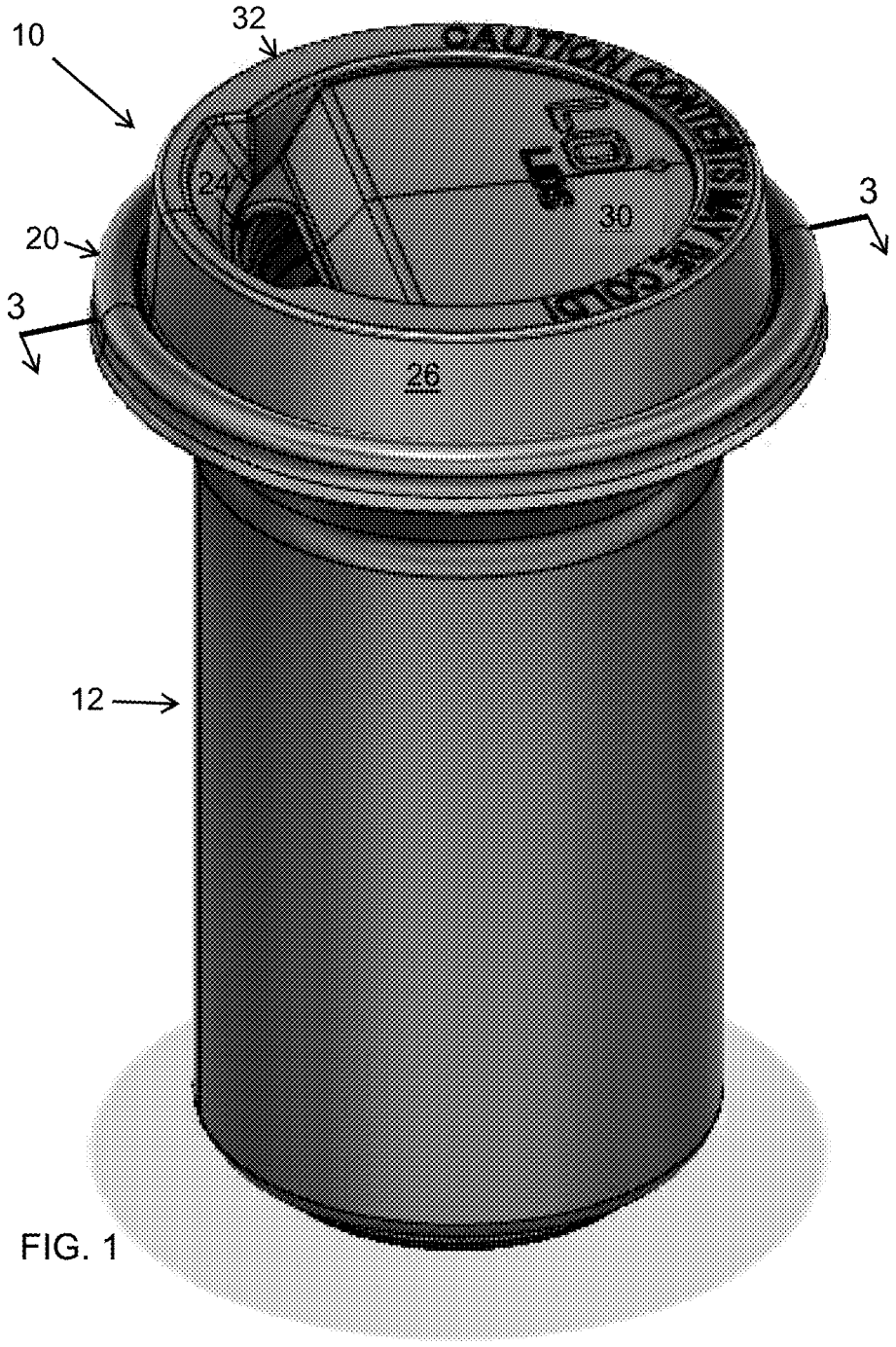
FIG. 1 is a perspective view showing an embodiment of the lid installed on a beverage can.
Figure 2:
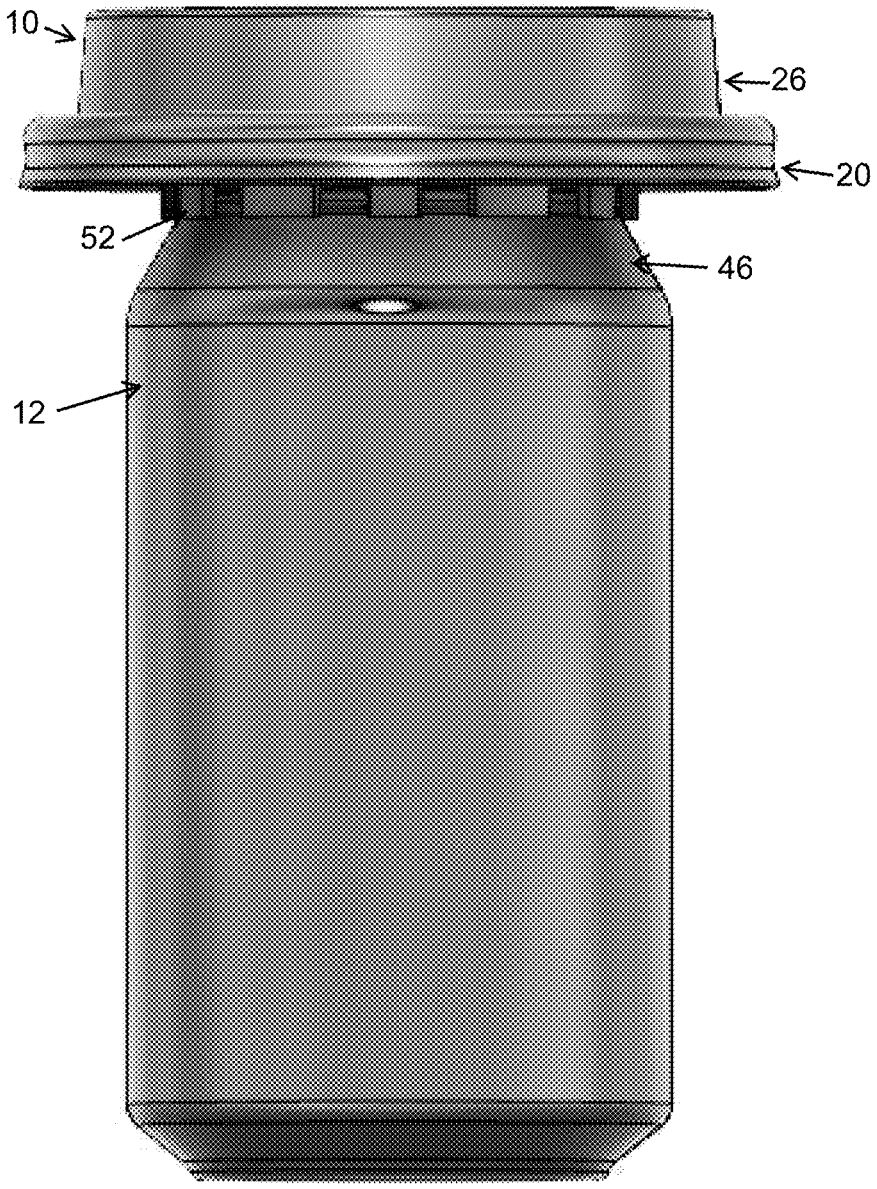
FIG. 2 is an elevation view of the embodiment of the lid installed on a beverage can as shown in FIG. 1.
Figure 3:
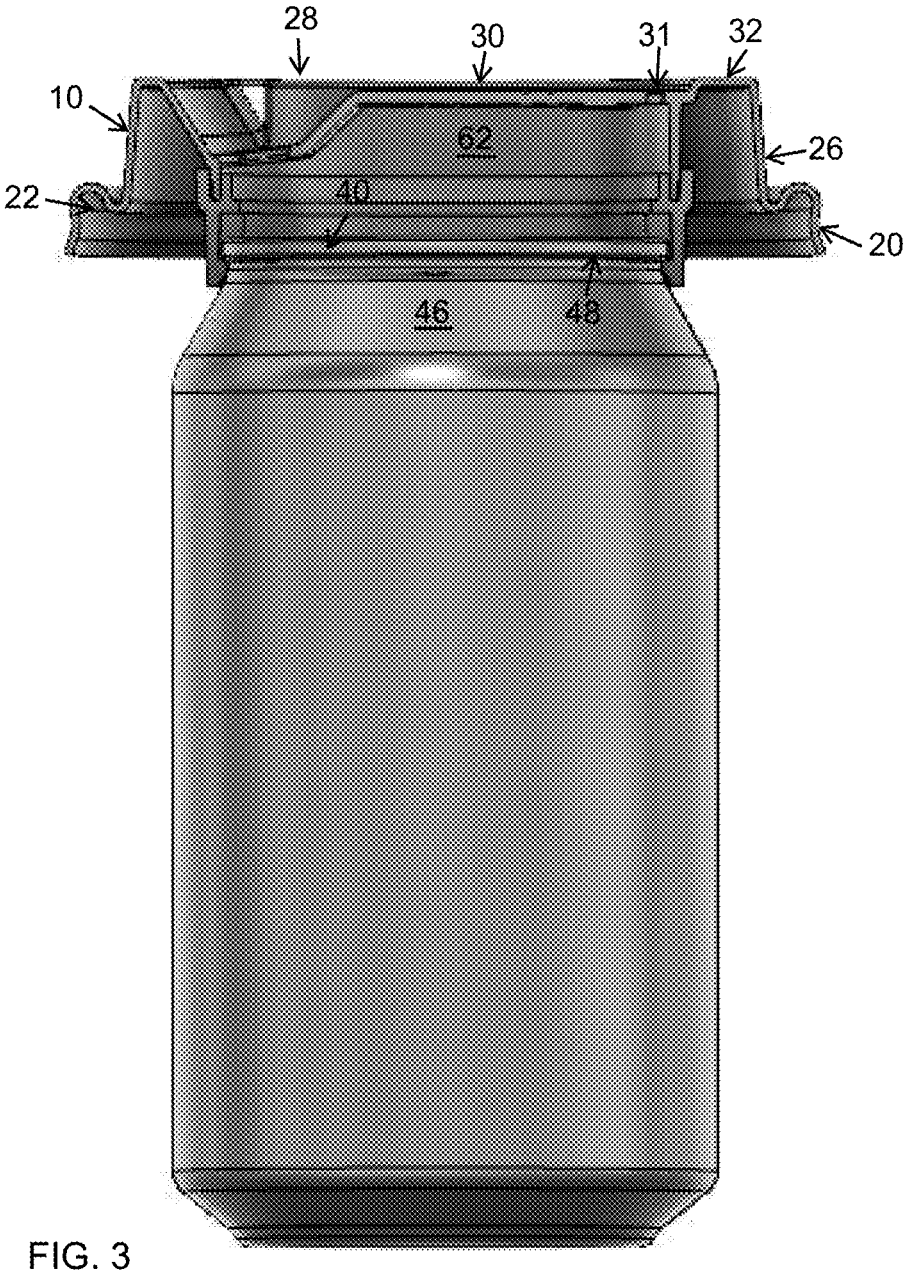
FIG. 3 is an elevation view of the embodiment of the lid installed on a beverage can as shown in FIG. 1, with the lid shown in cross-section along the lines 3-3 of FIG. 1.
Figure 4:
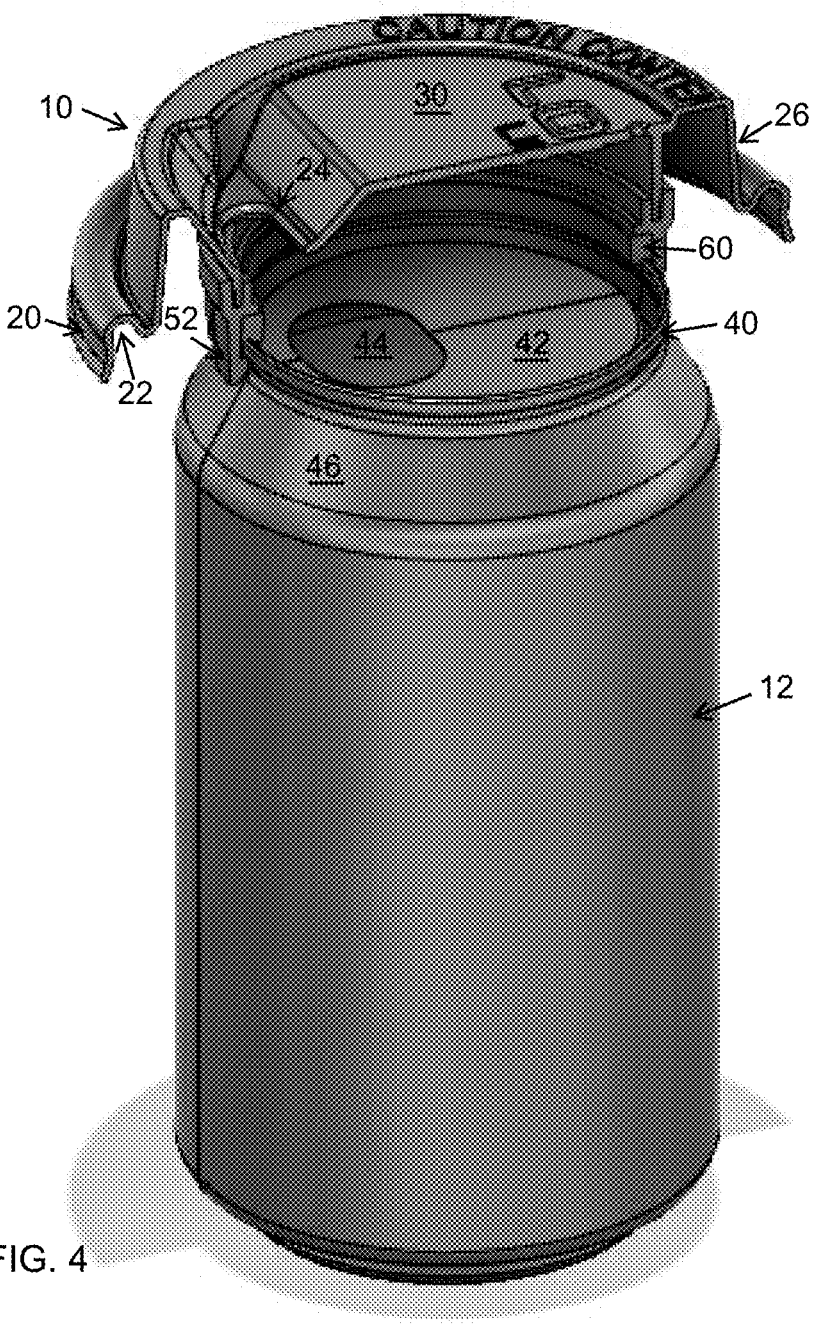
FIG. 4 is a perspective view of the embodiment of the lid installed on a beverage can as shown in FIG. 1, with the lid shown in cross-section along the lines 3-3 of FIG. 1.
Figure 5:
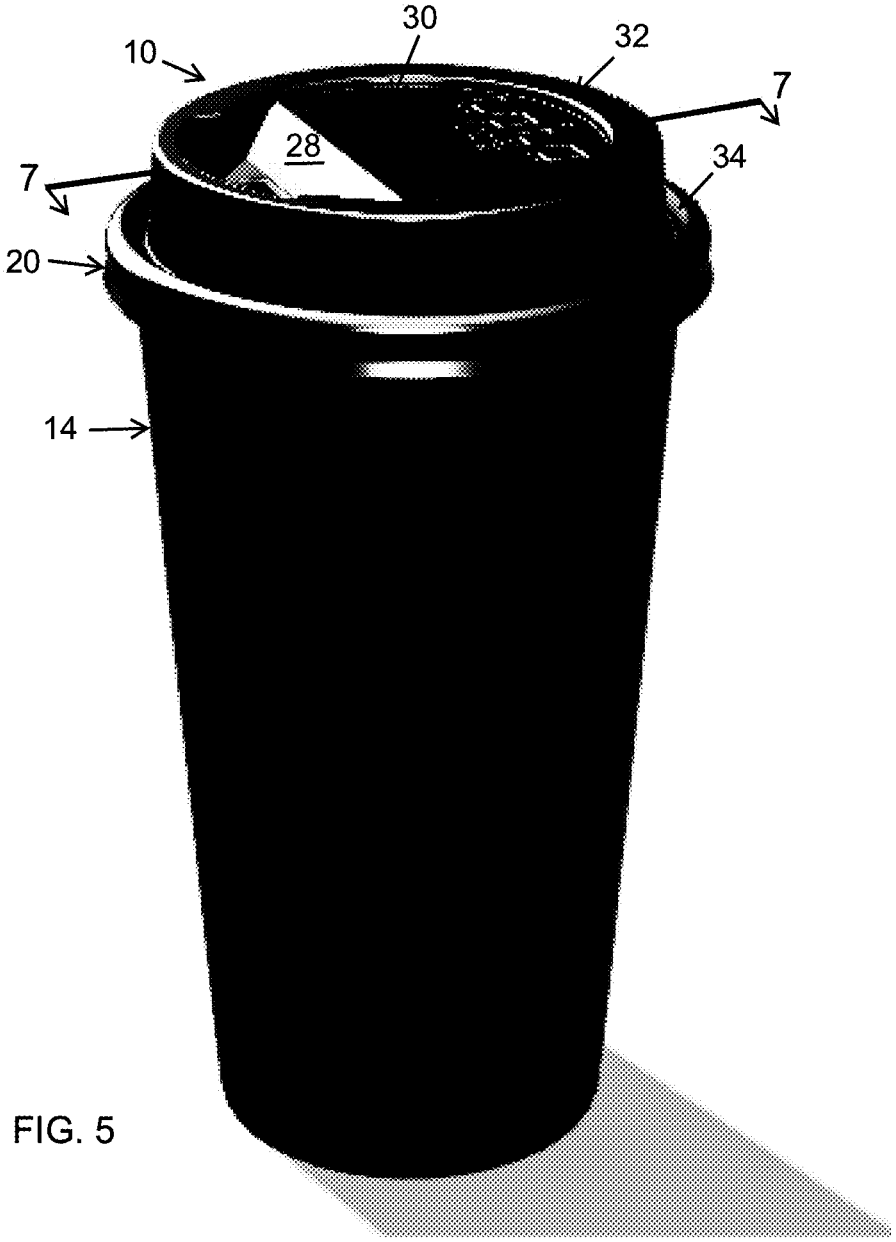
FIG. 5 is a perspective view of the embodiment of the lid installed on a beverage can as shown in FIG. 1.
Figure 6:
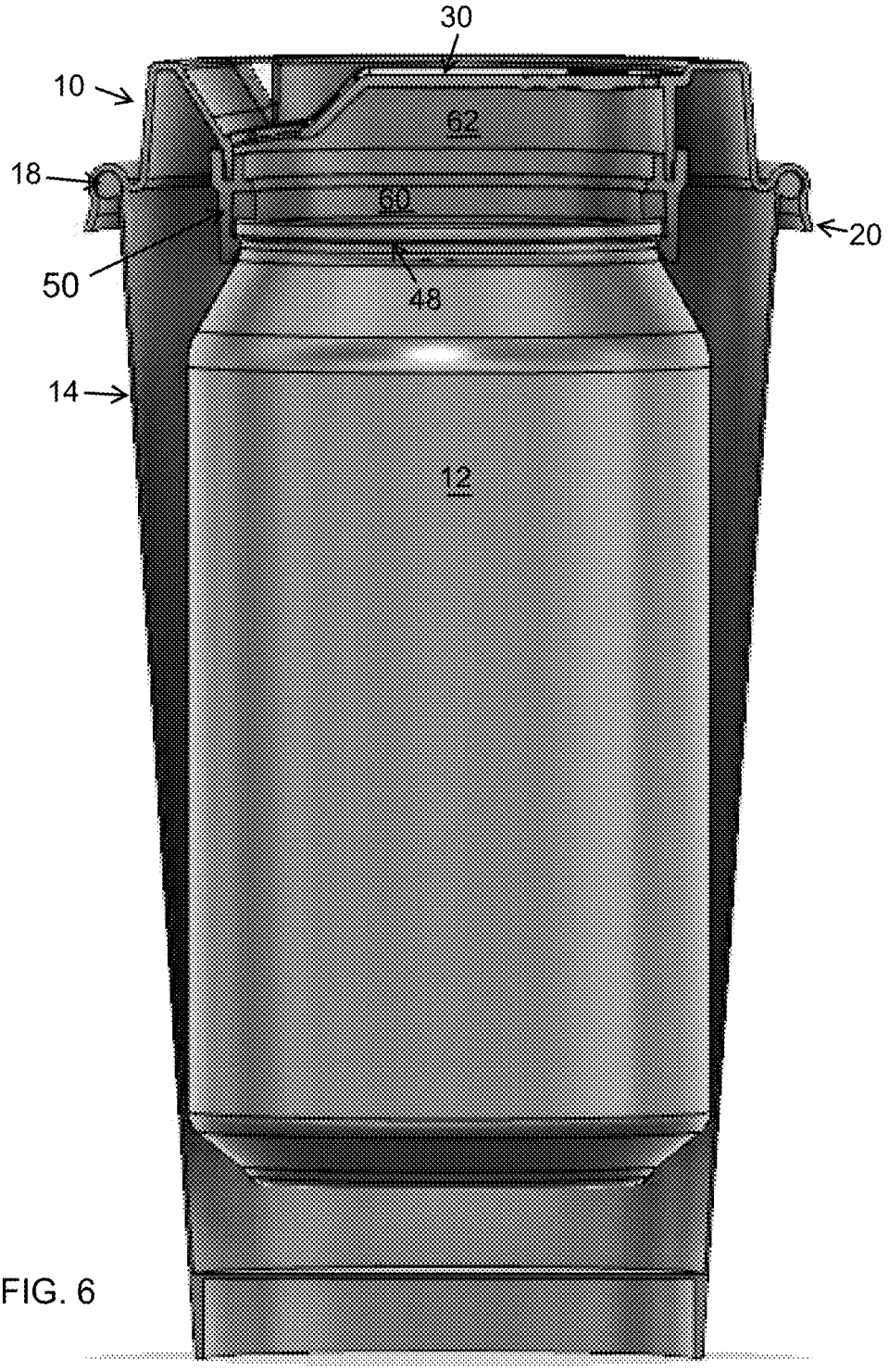
FIG. 6 is an elevation view of the embodiment of the lid installed on a beverage can as shown in FIG. 1, with the lid installed on a disposable beverage cup with the lid and cup cut away along the lines 7-7 of FIG.5.
Figure 7:
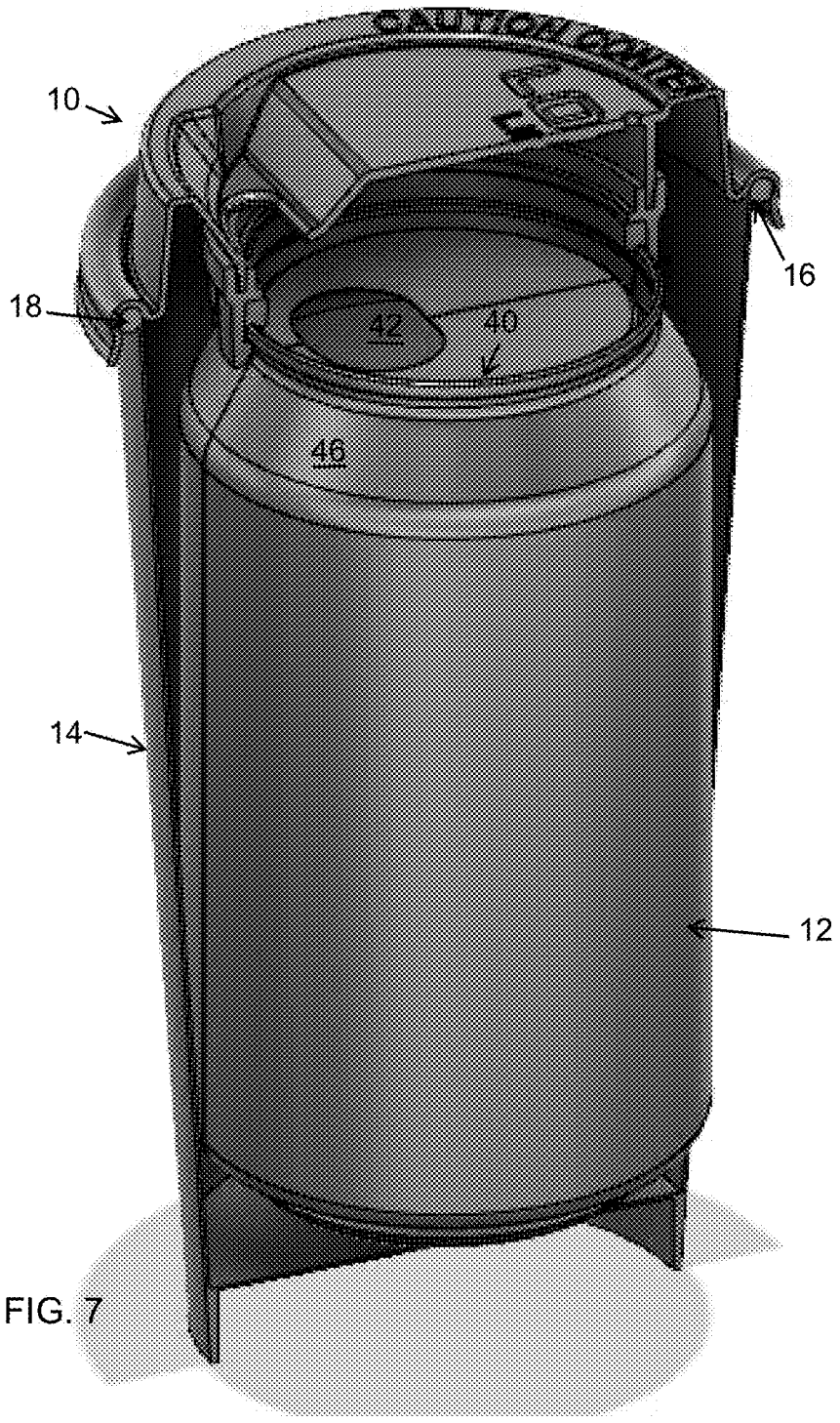
FIG. 7 is a perspective view of the embodiment of the lid installed on a beverage can as shown in FIG. 1, with the lid installed on a disposable beverage cup with the lid and cup cut away along the lines 7-7 of FIG. 5.
Figure 8:
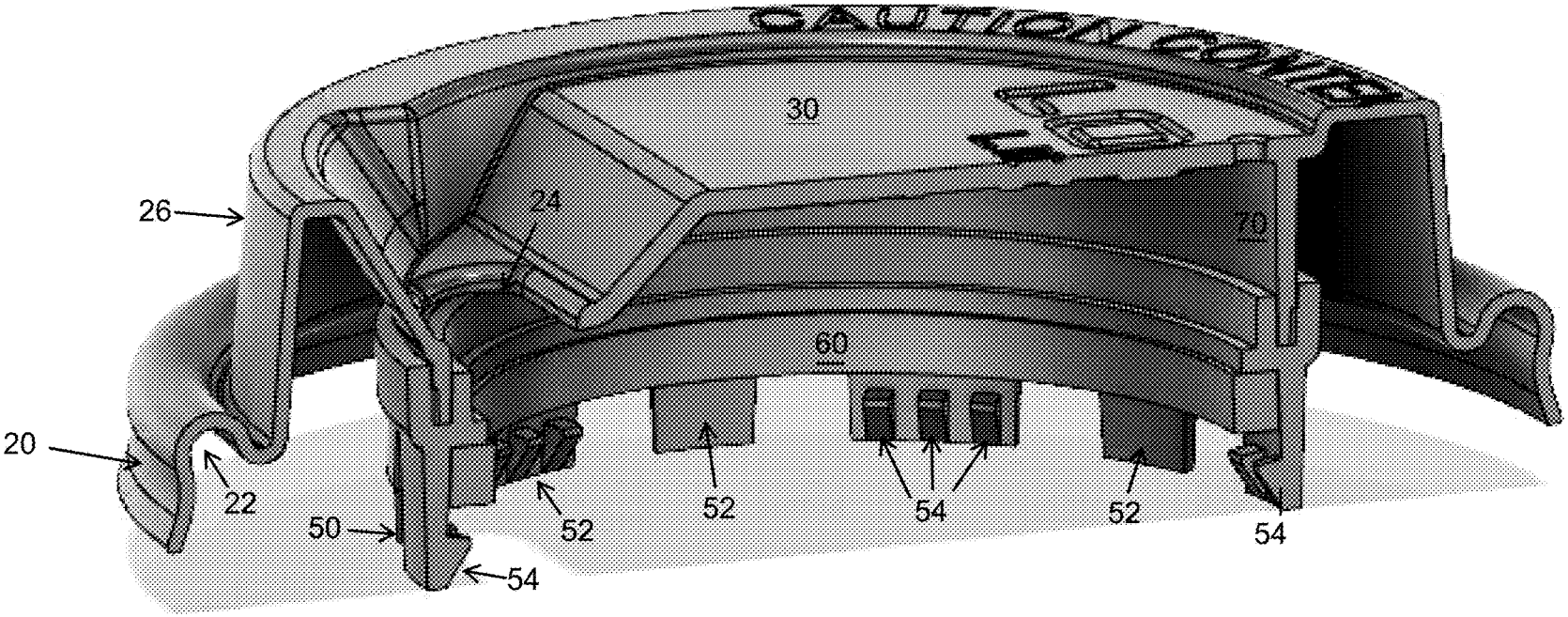
FIG. 8 is a perspective view of the embodiment of the lid as shown in FIG. 1, with the lid shown in cross-section along the lines 3-3 of FIG. 1.
Figure 9:
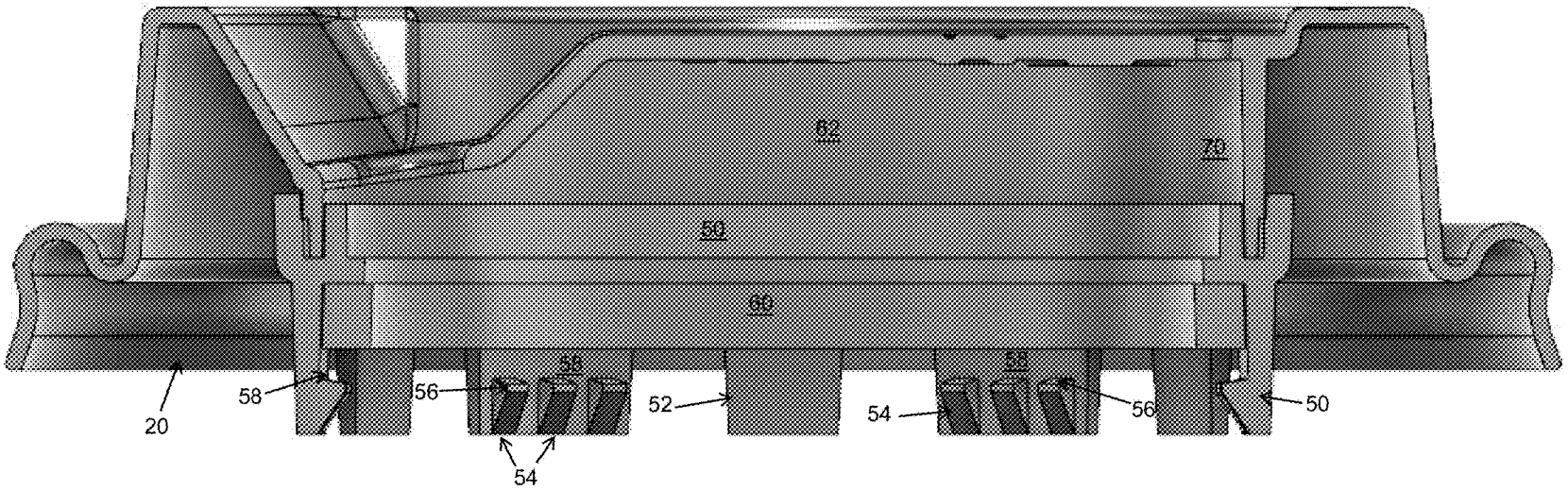
FIG. 9 is an elevation view of the embodiment of the lid as shown in FIG. 1, with the lid shown in cross-section along the lines 3-3 of FIG. 1.
Figure 10:
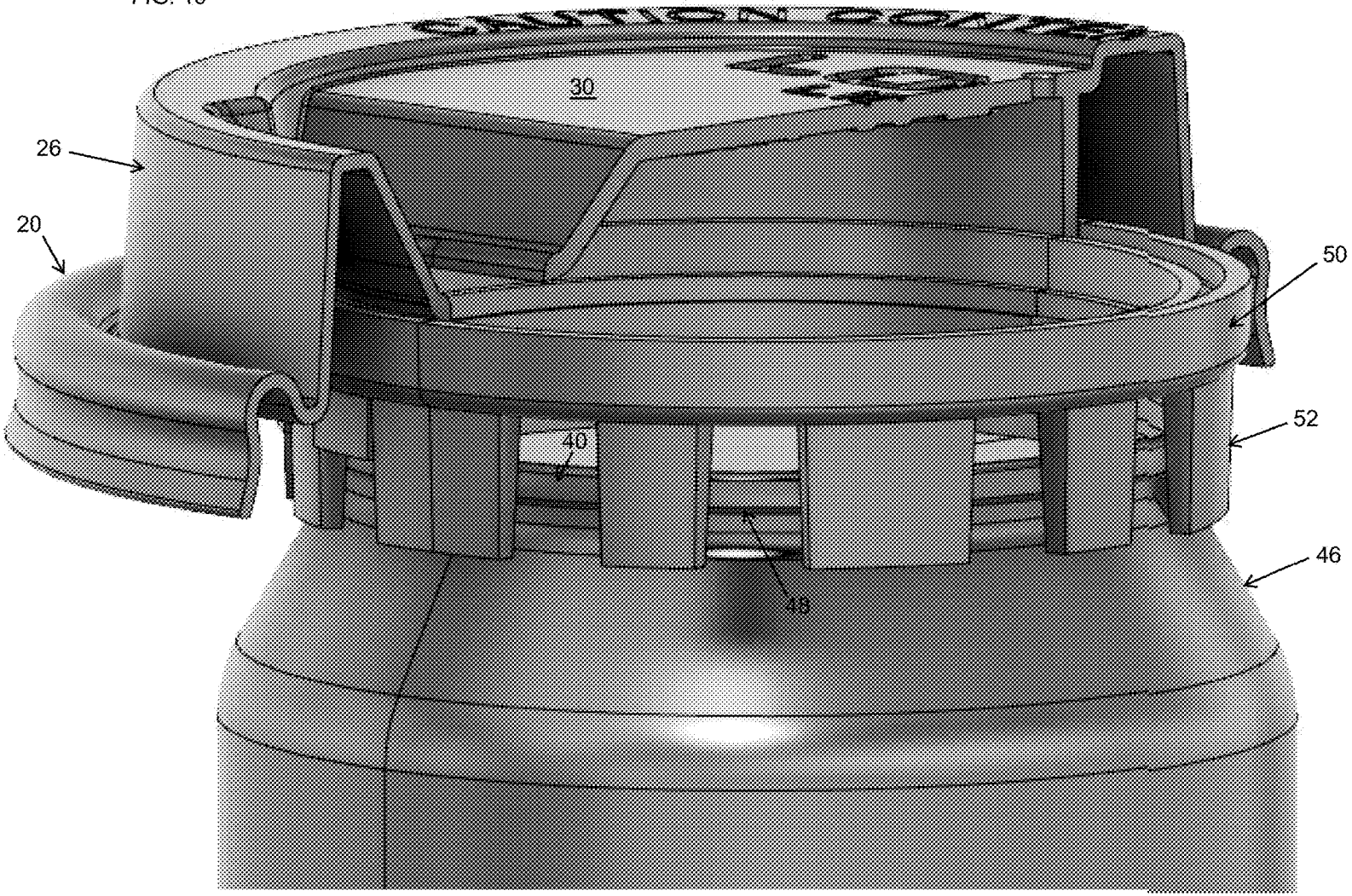
FIG. 10 is a detail perspective view of the embodiment of the lid installed on a beverage can as shown in FIG. 1, with the lid shown in cross-section along the lines 3-3 of FIG. 1 and the sealing gasket ring removed for ease of illustration.
Figure 11:
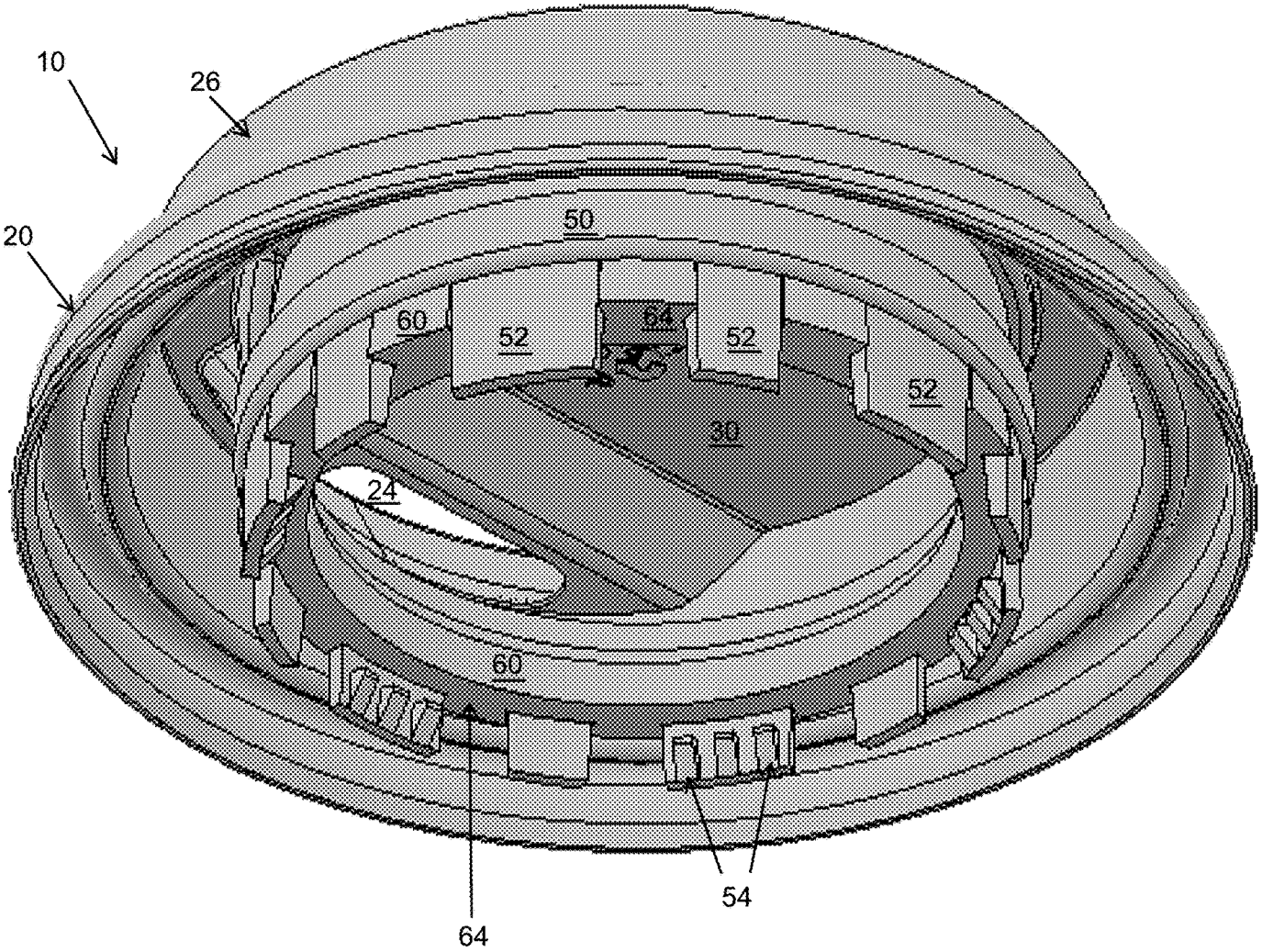
FIG. 11 is a bottom perspective view of the embodiment of the lid as shown in FIG. 1.
Figure 12:
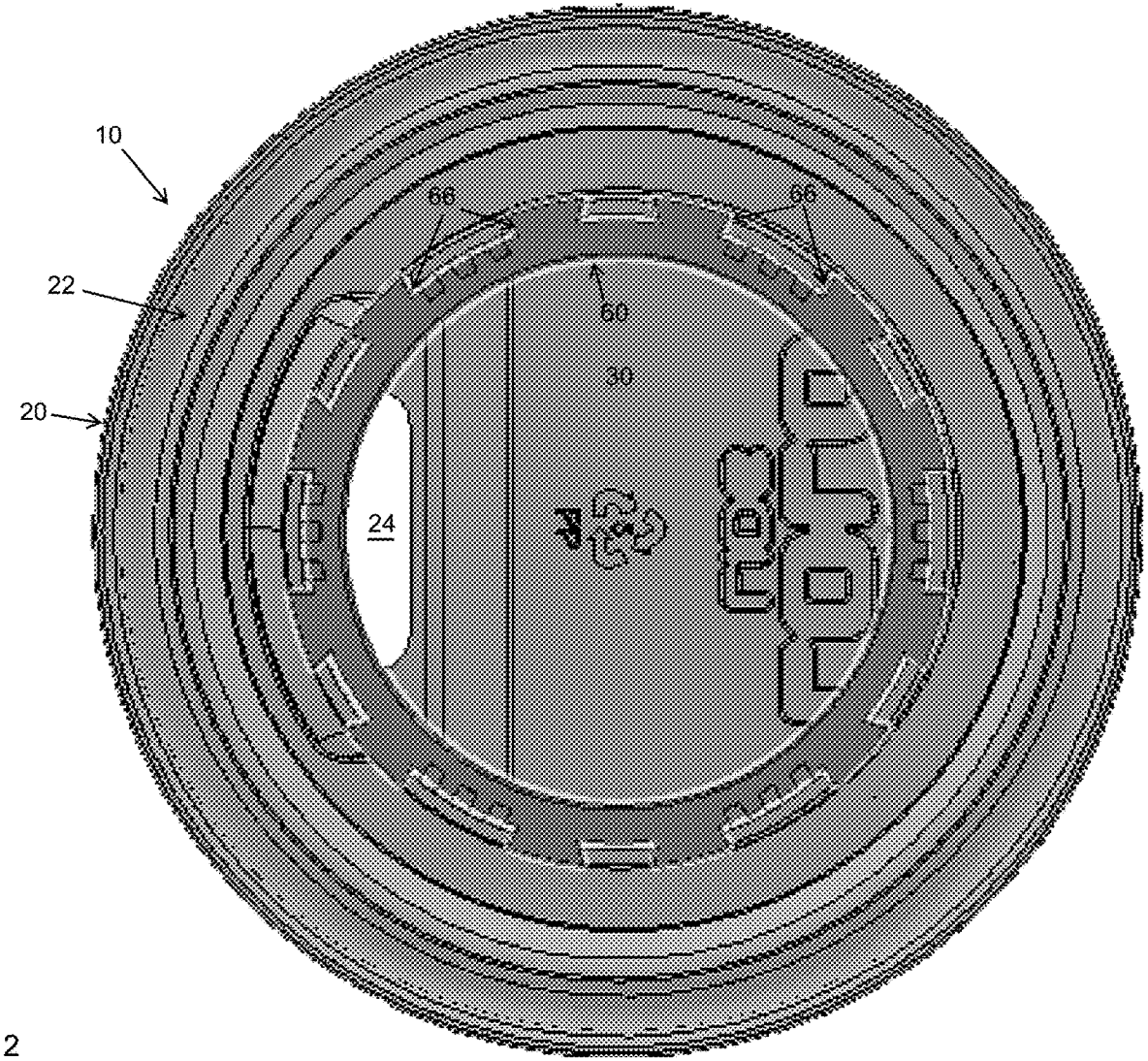
FIG. 12 is a bottom view of the embodiment of the lid as shown in FIG. 1.

With reference to FIGS. 1 through 4, the lid of an embodiment of the present invention is generally designated 10, shown installed for use on a beverage container 12, such as an aluminum beer or pop can. FIGS. 5 through 7 illustrate the lid 10 with attached beverage can 12 secured on a standard disposable paper cup 14, such as a disposable paper coffee cup. It will be understood that while aluminum beer or pop cans are used for illustration of beverage can 12 in this embodiment, other forms of containers made from different materials can also be supported by embodiments of lid 10, with suitable modifications to install the lid on different supporting beverage containers 14 of other materials such as Styrofoam or plastic. Standard beverage can 12 has an upwardly extending circular rim 40 which extends around the circumference of top 42 of can 12, and which is provided with a pouring spout 44, sealed prior to use but openable typically by a pop-top tab (not shown). The lower edge of circular rim 40 extends radially outwardly from the outer surface of the side wall 46 of can 12, forming a horizontally extending shoulder 48.

As shown in FIGS. 6 and 7, cup 14 has a generally circular upper lip or rim 16 with its upper edge configured as a round bead 18. As with standard disposable cup lids, lid 10 is configured to be removably and sealingly secured in place on cup 14 by an annular mounting skirt 20 which has a circular depression or recess 22 which is shaped to engage bead 18 with a snap fit, thereby sealing the lid to the cup 14. This is accomplished by pressing lid 10 downwardly onto rim 16 of cup 14, which may be facilitated by pressing down on skirt 20 to force recess 22 over bead 18. Lid 10 can similarly be removed from cup 14 by pulling up on skirt 20 to thereby free bead 18 from recess 22. Cup 14 is of a large enough size (vente) so that the lower edge of the beverage can 12 can be accommodated within it, when supported by lid 10, without touching the sides of cup 14, as shown in FIGS. 6 and 7.

According to one embodiment, an opening 24 is formed in lid 10 to enable the user to drink from beverage container 12, as described below, although different configurations for the drinking opening 24 are possible, such as a closeable flap or a spout (not shown). An annular side wall 26 may be provided on lid 10, as shown in the illustrated embodiment, to make the lid 10 conform more comfortably to the lips of the user, as well as a depression 28 in the vicinity of the opening 24. Lid 10 may also include upper wall 30 which extends across the top of the lid 10 and has a generally annular rim 32 adjoining the side wall 26. A vent hole 31 is provided in upper wall 30 to allow air pressure to enter chamber 62 while the user is drinking to permit liquid to flow out opening 24. An annular channel 34 may also be provided between side wall 26 and skirt 20 to retain liquid which would otherwise spill down the sides of cup 14.

FIGS. 3-4 and 8-12 illustrate the features of lid 10 which permit it to suspend beverage can 12 within cup 14 for drinking purposes. Extending downwardly from, and secured to or forming part of the lower surface of upper wall 30 is securement ring 50. Securement ring 50 has a plurality of vertically extending tabs 52, which are resiliently deformable and on some or all of which are formed a plurality of triangular teeth 54. Also fixed to the inner circumference of securement ring 50 is a resilient sealing gasket ring 60. Teeth 54 have an upper shoulder 56 which is spaced from the lower edge of sealing gasket ring 60, forming a rim-receiving channel 58. Teeth 54 are sized and configured so that when securement ring 50 is pressed down onto rim 40 of can 12, teeth 54 can deform outwardly and then snap back to bear against shoulder 48 of rim 40 and sealingly secure rim 40 between teeth 54 and sealing gasket ring 60. The upper edge of rim 40 is thereby sealed tightly against the lower surface 64 of sealing gasket ring 60 within rim-receiving channel 58. This then forms a liquid-tight seal between lid 10 and rim 40, and forms a liquid holding chamber 62 between top 42 of can 12 and upper wall 30 of lid 10. Sealing gasket ring 60 preferably has notches 66 formed on its circumference which receive tabs 52 of securement ring 50 to assist in positioning the sealing gasket ring.

To use lid 10, the pop-top tab of beverage can 12 is opened, and lid 10 is installed on can 12 by pressing the tabs 52 of securement ring 50 onto rim 40 of can 12 to thereby sealingly secure lid 10 to the rim 40 of can 12. Can 12 is then inserted into the interior of cup 14 as shown in FIG. 6 and the skirt 20 of lid 10 is snapped onto the rim 16 of cup 14. The user can then drink from can 12 by tipping cup 14 so that liquid flows from can 12 into chamber 62 and out opening 24. The user can thereby drink from the beverage can without directly touching it. Also, observers are unaware that the user is drinking from beverage can 12, rather than from disposable paper cup 14 such as a coffee cup. When finished drinking from can 12, lid 10 is removed from the rim 16 of cup 14 and further removed from rim 40 of can 12, and is then free for washing and subsequent use.

The foregoing construction thus has improved hygiene for users who may be reluctant to place their lips on the mouth or rim of the can for hygienic reasons, such as where the can has been stored in public places or facilities. The user's lips will only touch the lid which can be washed and carried for that purpose by the user. In that case the use of the cup 14 in addition to the lid may be superfluous other than for insulating or camouflaging purposes.

The lid 10 and securement ring 50 may be molded separately by one piece molded plastic construction, from a plastic such as polypropylene #5 The two pieces may then be spin welded together by the annular downwardly extending ring 70 forming part of lid 10 melting its way into the cavity of securement ring 50 due to friction as it spins. Sealing gasket ring 60 may be made of silicone, such as a food grade silicone compound, in order to form a resilient liquid seal.

While the lid has been described for suspending a can containing cold beverages, it is also suitable for suspending a metal can containing a hot beverage within a disposable cup, such as tea or coffee, to thereby permit the hot beverage or liquid such as soup to be consumed from the metal can without burning the user's hand, or without the user's lips touching the can surface.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A lid for a drinking cup having a circular rim and a hollow interior, said lid adapted for suspending a cylindrical beverage can within said hollow interior of said drinking cup, said beverage can being of the type comprising a generally horizontal top provided with an openable beverage-dispensing opening, and a generally vertical side wall joining said top in a vertically extending rim, said lid comprising:

a top having a generally circular periphery;

a drinking opening in said top to enable drinking from the interior of said drinking cup without removal of the lid; and an annular mounting portion for sealingly engaging the rim of said drinking cup; said lid having an annular ring secured to said lid and extending downwardly along the central axis of said lid, said annular ring comprising means for releasably gripping the rim of said cylindrical beverage can, and a liquid-sealing gasket located and configured to removably seal said lid to said rim of said beverage can, thereby forming a liquid-retaining chamber located radially inwardly of said annular ring and communicating between said beverage-dispensing opening of said beverage can and said drinking opening of said lid.

2. The lid of claim 1 wherein said annular ring comprises a plurality of downwardly extending flexible tabs for gripping said rim of said can.

3. The lid of claim 2 wherein a plurality of said plurality of downwardly extending flexible tabs for gripping said rim of said can each comprise one or more radially—extending elements for engaging the rim of said beverage can.

4. The lid of claim 3 wherein said one or more radially—extending elements comprise an upwardly-facing shoulder to bear against a lower surface of said rim of said beverage can.

5. The lid of claim 4 wherein said gasket has a downwardly-facing annular surface which forms with said upwardly-facing shoulder a channel for receiving said rim of said beverage can.

6. The lid of claim 3 wherein said one or more radially—extending elements for engaging the rim of said beverage can comprise one or more triangular teeth secured to and extending radially inwardly from annular ring.

7. The lid of claim 1 wherein said gasket is held by said annular ring to engage said rim of said beverage can.

8. The lid of claim 1 having an annular side wall depending from said top about its periphery.

9. The lid of claim 1 having a recess formed in said top for receiving the upper lip of a person drinking from the cup.

10. The lid of claim 9 wherein said drinking opening is located in said recess for receiving the upper lip of a person drinking from the cup.

11. The lid of claim 1 wherein said generally circular rim of said drinking cup has a bead formed thereon, and said annular mounting portion comprises an annular skirt having a circular recess for releasably and sealingly gripping said bead to retain said lid on said cup.

12. A method of dispensing a beverage from a cylindrical beverage can of the type comprising a generally horizontal top provided with an openable beverage-dispensing opening, and a generally vertical side wall joining said top in a vertically extending rim, using the lid of claim 1, comprising:

i) opening the beverage-dispensing opening of said can;

ii) sealingly securing said lid to said rim of said beverage can; and iii) sealingly securing said lid to said rim of a disposable cup, wherein said disposable cup is sized to fully contain said beverage can in the interior of said disposable cup.

* * * * *